252-103 AU 166 EX
11/10/81 XR 4,299,716

United States Patent [19]
Cottrell et al.
[11] 4,299,716
[45] * Nov. 10, 1981

[54] DETERGENT COMPOSITIONS

[75] Inventors: John S. Cottrell, South Wirral; Peter J. Powers, Wirral, both of England

[73] Assignee: Lever Brothers Company, New York, N.Y.

[ * ] Notice: The portion of the term of this patent subsequent to Nov. 10, 1998, has been disclaimed.

[21] Appl. No.: 126,518

[22] Filed: Mar. 3, 1980

[30] Foreign Application Priority Data

Mar. 6, 1979 [GB] United Kingdom ..... 7859/79

[51] Int. Cl.³ ..... C11D 7/54
[52] U.S. Cl. ..... 252/99; 252/103; 252/174.14
[58] Field of Search ..... 252/174.14, 99, 103

[56] References Cited

U.S. PATENT DOCUMENTS 4,196,003 4/1980 Clarke et al. ..... 252/99

*Primary Examiner*—Mayer Weinblatt
*Attorney, Agent, or Firm*—Melvin H. Kurtz

[57] ABSTRACT

The invention relates to a detergent composition in powder or bar form containing a surfactant, an alkali metal carbonate and a low level (1 to 5%) of orthophosphate, other phosphates being maintained at a level below 5%. A peroxygen bleach and other conventional additives are optionally present. The compositions are suitable for washing fabrics in developing countries and are suitable as low cost products elsewhere.

6 Claims, No Drawings

DETERGENT COMPOSITIONS

TECHNICAL FIELD

The present invention relates to detergent compositions in particulate or bar form which are adapted for fabric washing. The invention concerns in particular such compositions which are suitable for washing by hand in cool, i.e. cold or lukewarm water, as occurs widely in so-called developing countries and low cost formulations for use in developed countries.

BACKGROUND ART

A major problem in formulating detergent products for fabric washing by hand and in cool water, is the difficulty in reconciling the need for a highly effective detergency builder system which will adequately soften water during use under adverse washing conditions, which often also include low product dosage, with the fact that the users of such compositions cannot in general afford the most effective systems which would otherwise be desired. Nor indeed do the economies of the developing countries always permit the importation of large tonnages of foreign detergency builder materials such as sodium tripolyphosphate.

It has been proposed previously to use sodium carbonate as a detergency builder, and this material is widely available and relatively cheap. Unfortunately, however, sodium carbonate when used alone as the detergency builder does not function so effectively as would be desired, particularly at cool washing temperatures. Although the level of calcium ion concentration is lowered to sufficient level by the presence of sodium carbonate, i.e. by precipitation of calcium carbonate, the precipitation process is a slow one and during the early part of the wash cycle the calcium concentration is higher than is desired for effective washing. During the initial period before the sodium carbonate is fully effective, there can be interaction between the calcium ions present and other ingredients in the detergent compositions. For example anionic detergent surfactants such as some sodium alkyl benzene sulphonates can be precipitated in the form of the calcium salts and this therefore contributes to a further reduction in detergency. Other types of detergent surfactants are known which are not precipitated by calcium ion, for example nonionic detergent surfactants, but these more sophisticated detergent surfactants tend to be more expensive, which mitigates against their use in relatively cheap formulations.

DISCLOSURE OF THE INVENTION

The present invention seeks to provide a way of improving the effectiveness of sodium carbonate as a detergency builder, particularly under adverse washing circumstances, but without imposing a heavy cost burden on the compositions. This has been achieved by including a low level of an orthophosphate salt in the composition.

According to the present invention, there is provided an alkaline detergent composition for fabric washing comprising a detergent surfactant and an alkali metal carbonate, containing (i) from about 10% to about 40% of a synthetic anionic, nonionic, amphoteric or zwitterionic detergent surfactant or mixture thereof;

(ii) from about 10% to about 40% of an alkali metal carbonate;

(iii) from about 1% to less than 5% of an orthophosphate material selected from orthophosphoric acid and the ammonium, sodium or potassium salts thereof; and (iv) not more than 5% of other phosphate builder salts, all percentages being by weight of the composition.

The composition may be in powder form or in the form of a laundry bar.

It has been found that the addition of the orthophosphate material together with the alkali metal carbonate achieves a much more cost-effective building performance than either of the materials would do alone. It appears that the presence of the low level of orthophosphate makes the calcium ion concentration drop very quickly to a satisfactory low level, after which the sodium carbonate maintains the calcium ion concentration at the low level. The resultant detergent compositions are cheaper because of the unsophisticated builder systems, and yet give satisfactory detergency under the adverse washing conditions.

BEST MODE OF CARRYING OUT INVENTION

The orthophosphate material used may be either potassium or preferably sodium orthophosphate, as the latter is cheaper and more readily available. Normally the trialkali metal salts are used, but orthophosphoric acid or the di- or mono-alkali metal salts, e.g. disodium hydrogen orthophosphate or monosodium dihydrogen orthophosphate could be used if desired to form the compositions. In the latter event other more alkaline salts would also be present to maintain a high pH in the end product, with full neutralisation to the trialkali metal orthophosphate salts. The use of a mixture of the monosodium and disodium hydrogen orthophosphates in the ratio of about 1:3 to 2:3, especially about 1:2, is particularly advantageous, as such a mixture is made as a feedstock for the production of sodium tripolyphosphate and is therefore readily available. The alkali metal orthophosphate can be used initially as the anhydrous or hydrated salt, for example as trisodium orthophosphate dodecahydrate. The amounts oof the alkali metal orthophosphate are calculated in anhydrous form although it is preferred that the salts should be at least partially hydrated in the final detergent compositions, whether by initial use of the hydrated salts or by hydration during powder production. The amount of the alkali metal orthophosphate salt is preferably about 1% to about 4.5% by weight of the composition. Advantageously, the amount of phosphorus in the formulation, in the form of the orthophosphate, is from about 0.2% to about 1.5%.

Some other phosphate builder salts may be present at low levels, e.g. not exceeding 5% by weight of the composition, although this is not normally desired. Low levels of other phosphates are commonly present as impurities in the alkali metal orthophosphates supplied, so the presence of the other phosphates may in practice be unavoidable. Such other phosphate builder salts include in particular sodium tripolyphosphate and sodium pyrophosphate and the corresponding potassium salts when portassium orthophosphate is used.

The alkali metal carbonate salt used may be potassium or preferably sodium carbonate or a mixture thereof. The carbonate salt is generally fully neutralised, but it may contain some potassium or sodium bicarbonate or sesquicarbonate. Alkali metal percarbonate may also be used.

The amount of the alkali metal carbonate used can be varied between about 10% and about 40% by weight of the compositions but it is preferred to use an amount of about 15% to about 30% by weight, and at least about 10% of the carbonate must be fully neutralised, based on the weight of the composition. The amount of the alkali metal carbonate is determined on an anhydrous basis, although the carbonate salt may be hydrated before or during detergent production. The amount of bicarbonate can be up to about 20% by weight of the composition, which is equivalent to up to about 40% of sesquicarbonate, but it is preferred to have a bicarbonate content of about 5% to 15% of the composition.

The detergent compositions must include from about 10% to about 40% by weight of a synthetic detergent surfactant. It is preferred to have a relatively high level of detergent surfactant present in the compositions, that is at least about 20% by weight of the compositions as this facilitates the production of adequate lather levels under the conditions of usage in the developing countries, generally with a maximum level of about 30% for reasons of cost.

It is particularly preferred to use an anionic detergent surfactant as these tend to be cheaper and more readily availably in developing countries. The alkali metal alkyl benzene sulphonates, especially sodium linear secondary alkyl ($C_{10}$–$C_{15}$) benzene sulphonate, are particularly preferred. However, other anionic detergent surfactants which are generally water-soluble alkali metal salts or organic sulphates and sulphonates having alkyl radicals containing from about 8 to 22 carbon atoms may be employed. Examples of such other anionic detergent surfactants are sodium and potassium alkyl sulphates, especially those obtained by sulphating higher ($C_8$–$C_{18}$) alcohols produced for example from tallow or coconut oil; sodium alkyl glyceryl ether sulphates, especially those ethers of the higher alcohols derived from petroleum; sodium coconut oil fatty acid monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphates such as those derived by reacting alphaolefins ($C_8$–$C_{20}$) with sodium bisulphite and those derived by reacting paraffins with $SO_2$ and $Cl_2$ and the hydrolysing with a base to produce a random sulphonate; and olefin sulphonates, which term is used to describe the material made by reacting olefins, particularly $C_8$–$C_{20}$ alphaolefins, with $SO_3$ and then neutralising and hydrolysing the reaction product.

Nonionic detergent surfactants may be used in the detergent compositions although this is not generally desired because of their relatively high costs and because they tend to result in decreased lather properties. However, they may be used to give a boost to detergency properties at relatively low levels of for example up to about 5% of the composition. The nonionic detergent surfactants are the reaction products of compounds having hydrophobic groups and a reactive hydrogen atom, for example aliphatic alcohols, acids, amides or alkyl phenols with alkylene oxides, especially ethylene oxide either alone or with propylene oxide. Specific nonionic detergent surfactants are alkyl ($C_6$–$C_{22}$) phenol-ethylene oxide condensates, generally 5 to 25 EO, i.e. 5 to 25 units of ethylene oxide per molecule; the condensation products of aliphatic ($C_6$–$C_{18}$) primary or secondary linear or branched alcohols with ethylene oxide, generally 6 to 30 EO, and products made by condensation of ethylene oxide with the reaction products or propylene oxide and ethylenediamine. Other so-called nonionic detergent surfactants include long chain tertiary amine oxides, long chain tertiary phosphine oxides and dialkyl sulphoxides. Mixtures of amine oxides with ethoxylated nonionic compounds can also be used.

Amounts of amphoteric or zwitterionic detergent surfactants may also be used in the compositions of the invention but this is not normally desired due to their relatively high cost. If any amphoteric or zwitterionic detergent surfactants are used it is generally in small amounts in compositions based on the much more commonly used synthetic anionic and/or nonionic detergent surfactants.

Apart from the essential detergent surfactants and detergency builders, the detergent compositions of the invention can contain any of the conventional additives in amounts of which such materials are normally employed in fabric washing detergent compositions. However, the need to control the cost of products in practice precludes the use of more expensive additives. Moreover, the washing conditions employed, particularly hand washing in cool water, make it less practical to use lather depressants, oxygen-based bleaching agents such as sodium perborate and sodium percarbonate with or without peracid bleach precursors, or enzymes such as proteases and amylases. However, where different washing conditions are used, such as machine washing at moderate or high temperatures, such additives will generally be included in the compositions, in particular from about 10% to about 50% of a peroxygen bleach. The additives which are more commonly used in detergent compositions suitable for the developing countries include lather boosters such as alkanolamides, particularly the monoethanoamides derived from palm kernel fatty acids and coconut fatty acids, antiredeposition agents such as sodium carboxymethylcellulose, alkaline buffers such as sodium silicate, fluorescent agents, perfumes and colourants and the like.

It is particularly preferred to have present an inorganic filler salt to provide the compositions with sufficient bulk at an acceptable cost. The amount of the filler salt is from about 5% to about 50%, preferably about 15% to about 40%, by weight of the composition. These filler salts are generally considered to be inert materials, although in the case of the soluble salts there can be some small effect on detergency due to their affecting the ionic concentration. When any insoluble filler materials are used such as calcium carbonate, it is important to have them as finely divided as possible so as not to cause undue deposition on the fabric being washed. Examples of other suitable inorganic fillers are borax, magnesium silicate, talc, calcium sulphate, sodium aluminosilicate and bentonite or other clays.

As both alkali metal orthophosphate and alkali metal carbonate salts function as detergency builders by precipitation of their insoluble calcium salts, it can be advantageous to include an amount of an antideposition aid to inhibit deposition of such insoluble salts on the fabrics. The most effective antideposition aids are anionic polyelectrolytes, especially polymeric aliphatic carboxylates, for example alkali metal or ammonium, e.g. sodium, salts of homo- and co-polymers of acrylic acid or substituted acrylic acids. The amounts of any such antideposition aids is normally from about 0.05% to about 5% by weight, preferably from about 0.1% to about 2% by weight, of the compositions. However, as such polymeric additivies tend to be relatively expensive they are preferably used, if at all, at low levels within this range in the compositions of the invention.

Some soap may also be included in the compositions of the invention but not as the sole detergent surfactant. In general the soaps are relatively expensive and if used at only low levels they can have an undesirable suds depressing action. However, in some countries soap may be more widely available than imported synthetic detergent surfactants in which case a proportion of soap may be used, preferably not exceeding about half of the total surfactant present.

The compositions of the invention are required to be alkaline, but not too strongly alkaline as this could result in fabric damage and also be hazardous for use, especially in manual washing. It is desired in practice that the composition should give a pH of from about 9 to 11 in use in aqueous wash solution, preferably from about 9.5 to 10.5, as measured at a product concentration of about 0.1% w/v in water of 12° H (Ca) at 25° C. The pH of the detergent compositions in use is controlled by the amount and type of alkali metal orthophosphate and alkali metal carbonate salts present and on any other alkaline salts which may be used, especially alkali metal silicate.

Apart from its effect on pH control, the presence in the detergent compositions of an amount of an alkali metal silicate is generally advantageous in facilitating processing of the detergent compositions and giving generally improved powder properties. The type of alkali metal silicate used is preferably sodium silicate, for example sodium ortho-, meta- or preferably neutral or alkaline silicate. The more highly alkaline ortho- and meta silicates are normally only used at lower levels, in admixture with neutral or alkaline silicates.

The detergent compositions of the invention may be in particulate form, which includes powders and granules and they may be made by conventional techniques, for example by granulation or by slurry making and spray drying processes, preferably so as to give substantially homogenous products. The orthophosphate may be post-dosed to the composition. Alternatively, they may be in the form of laundry bars which may be formed by conventional methods such as mixing and extruding.

The invention is illustrated by the following Examples in which parts and percentages are by weight and in which the amounts of the ingredients are expressed on an anhydrous basis, except where otherwise indicated.

EXAMPLE 1

In order to demonstrate the beneficial effect on calcium ion lowering by using mixed sodium orthophosphate and sodium carbonate detergency builders, some compositions were prepared as follows:

| Ingredient | % | | | |
|---|---|---|---|---|
| | A | B | C | D |
| Sodium alkyl benzene sulphonate | 28 | 28 | 28 | 28 |
| Sodium orthophosphate | 4.5 | — | 4.5 | — |
| Sodium carbonate | 20 | 24.5 | — | 20 |

-continued

| Ingredient | % | | | |
|---|---|---|---|---|
| | A | B | C | D |
| Sodium silicate | 10 | 10 | 10 | 10 |
| Sodium sulphate | 27.5 | 27.5 | 47.5 | 32.0 |
| Water | 10 | 10 | 10 | 10 |

Each of these compositions was then added to water of initially 30° F. H (Ca) at 25° C., the product dosage being 3.5 g/l. The free calcium ion concentrations were then determined at intervals, with the following results:

| | | $Ca^{++}$ (°FH) | | | | | |
|---|---|---|---|---|---|---|---|
| Comp | Time: | Initially | ½ min | 1 min | 2 mins | 4 mins | 15 mins |
| A | | 30 | 2.1 | 1.9 | 2.0 | 2.1 | 2.0 |
| B | | 30 | 12.0 | 7.6 | 4.6 | 3.0 | 1.3 |
| C | | 30 | 15.0 | 14.0 | 14.0 | 14.0 | 14.0 |
| D | | 30 | 12.0 | 9.0 | 5.8 | 3.5 | 1.4 |

These results show a marked benefit for composition A made according to the invention.

EXAMPLES 2 TO 6

Six powdered detergent compositions including two control products E & F were prepared as follows:

| | E | Ex 2 | Ex 3 | F | Ex 4 | Ex 5 | Ex 6 |
|---|---|---|---|---|---|---|---|
| Sodium alkyl benzene sulphonate | 28 | 28 | 28 | 28 | 28 | 28 | 28 |
| Sodium orthophosphate | 2.2 | 2.2 | 2.2 | 4.5 | 4.5 | 4.5 | 4.5 |
| Sodium carbonate | 0 | 15 | 30 | 0 | 10 | 25 | 15 |
| Sodium bicarbonate | — | — | — | — | — | — | 15 |
| Sodium alkaline silicate | | | | 10.0 | | | |
| Sodium sulphate | 49.8 | 34.8 | 19.8 | 47.5 | 37.5 | 22.5 | 17.5 |
| Water | | | | to 100 | | | |

The detergency performance of these compositions were compared at product concentrations of 2.5 g/l, calcium hardness of 15° H (French), liquor to cloth ratio of 5:1 and temperature of 25° C. Three artificially soiled test cloths were used and the detergency found by determining the change in light reflectance before and after washing, with the following results:

| Composition | Test Cloth (Increase in light reflectance) | | |
|---|---|---|---|
| | Test Cloth A | Test Cloth B | Test Cloth C |
| Product E | 21.9 | 14.6 | 0.4 |
| Example 2 | 23.8 | 19.0 | 2.3 |
| Example 3 | 25.7 | 19.7 | 3.9 |
| Product F | 23.8 | 14.3 | −0.2 |
| Example 4 | 26.2 | 20.7 | 3.5 |
| Example 5 | 27.6 | 21.7 | 5.8 |
| Example 6 | 34.0 | 23.0 | 7.0 |

The benefit of having a high carbonate content together with the low orthophosphate level in the compositions of the invention is readily apparent, compared with the control products.

EXAMPLES 7 AND 8

The following formulations including four controls G to J were prepared:

| Ingredient | % G | 7 | 8 | H | I | J |
|---|---|---|---|---|---|---|
| Sodium alkyl benzene sulphonate | 28 | 28 | 28 | 28 | 28 | 28 |
| Sodium orthophosphate | 4.5 | 4.5 | 4.5 | 7.0 | — | — |
| Sodium carbonate | — | 30 | 10 | 30 | 30 | 10 |
| Sodium percarbonate | — | — | 29.6 | — | — | 29.6 |
| Sodium alkaline silicate | 10 | 10 | 10 | 10 | 10 | 10 |
| Sodium sulphate | 47.5 | 17.5 | 7.9 | 15 | 22 | 12.4 |
| Water | | | to 100 | | | |

The detergency performance of these compositions was investigated at product concentrations of 2.5 g/l, calcium hardness of 15° H. (French), liquor to cloth ratio of 5:1 and a temperature of 25° C. Three artificually soiled test cloths were used and the detergency found by determining the change in light reflectance before and after washing, with the following results:

| Formulation | Test Cloth (Increase in light reflectance) Test Cloth A | Test Cloth B | Test Cloth C |
|---|---|---|---|
| G | 28.1 | 21.2 | 6.4 |
| 7 | 30.7 | 22.6 | 8.5 |
| 8 | 31.1 | 22.8 | 8.6 |
| H | 31.0 | 22.5 | 8.8 |
| I | 26.2 | 18.8 | 5.5 |
| J | 26.4 | 18.4 | 5.7 |

The test cloths used in Examples 2 to 8 were as follows:

Test Cloth A-A mixture of sebum fatty acids and carbon black impregnated into cotton-poplin. Test Cloth B-A mixture of ground nut oil, indian ink, casein and iron oxide impregnated into cotton sheeting.

Test Cloth C-A mixture of bandy black clay, a nonionic detergent and a cationic detergent impregnated into cotton cloth.

The performance of the formulations of Examples 7 and 8 was investigated at 60° C., the other test conditions remaining the same, except that the test cloth was a tea stained cloth. The results were as follows:

| Formulation | Change in reflectance |
|---|---|
| Ex 7 | 0.1 |
| Ex 8 | 4.9 |

EXAMPLE 9

Detergent bars were prepared according to the following formulations:

| Ingredient | % Ex 9 | Control K |
|---|---|---|
| Sodium alkyl benzene sulphonate | 28 | 28 |
| Sodium orthophosphate | 4 | — |
| Sodium carbonate | 22 | 22 |
| Calcite | 30 | 35 |
| Sodium sulphate | 6 | 5 |
| Water | 10 | 10 |

The bars were used to hand wash Test Cloth C (referred to above) at a liquor to cloth ratio of 5:1, water hardness of 15° H. (French) and a wash temperature of 25° C. The test results were:

| Formulation | Change in reflectance |
|---|---|
| Ex 9 | 10.8 |
| K | 7.2 |

We claim:

1. An alkaline detergent composition for fabric washing containing
   (i) from about 10% to about 40% of a synthetic detergent surfactant selected from the groups consisting of anionic, nonionic, amphoteric and zwitterionic detergent surfactants and mixture thereof;
   (ii) from about 10% to about 40% of an alkali metal carbonate;
   (iii) from about 1% to less than 5% of an orthophosphate material selected from the group consisting of orthophosphoric acid and the ammonium, sodium or potassium salts thereof; and
   (iv) not more than 5% of other phosphate builder salts, all percentages being by weight of the composition.

2. A composition according to claim 1 wherein said orthophosphate material is selected from the group consisting of sodium and potassium orthophosphate salts.

3. A composition according to claim 2, wherein said orthophosphate material is present in an amount of from about 1% to about 4.5% by weight of said composition.

4. A composition according to claim 1, wherein said composition contains from about 0.2% to about 1.5% by weight of said composition of phosphorus in the form of said orthophosphate material.

5. A composition according to claim 1, wherein said composition additionally contains from about 10% to about 50% by weight of said composition of a inorganic peroxygen bleach other than an alkali metal percarbonate.

6. A composition according to claim 1, wherein said alkali metal carbonate is an alkali metal percarbonate.

* * * * *